US010142733B2

(12) United States Patent
Fujii

(10) Patent No.: US 10,142,733 B2
(45) Date of Patent: Nov. 27, 2018

(54) HEAD-RELATED TRANSFER FUNCTION SELECTION DEVICE, HEAD-RELATED TRANSFER FUNCTION SELECTION METHOD, HEAD-RELATED TRANSFER FUNCTION SELECTION PROGRAM, AND SOUND REPRODUCTION DEVICE

(71) Applicant: JVC KENWOOD Corporation, Yokohama-shi, Kanagawa (JP)

(72) Inventor: Yumi Fujii, Yokohama (JP)

(73) Assignee: JVC KENWOOD CORPORATION, Yokohama-Shi, Kanagawa (JP)

( * ) Notice: Subject to any disclaimer, the term of this patent is extended or adjusted under 35 U.S.C. 154(b) by 5 days.

(21) Appl. No.: 15/730,101

(22) Filed: Oct. 11, 2017

(65) Prior Publication Data

US 2018/0048959 A1 Feb. 15, 2018

Related U.S. Application Data

(63) Continuation of application No. PCT/JP2016/052711, filed on Jan. 29, 2016.

(30) Foreign Application Priority Data

Apr. 13, 2015 (JP) ..... 2015-081483

(51) Int. Cl.
*H04R 3/04* (2006.01)
*H04S 1/00* (2006.01)
(Continued)

(52) U.S. Cl.
CPC ..... *H04R 3/04* (2013.01); *H04S 1/00* (2013.01); *H04S 5/00* (2013.01); *H04S 5/02* (2013.01);
(Continued)

(58) Field of Classification Search
CPC ..... H04R 3/04; H04R 5/02; H04R 2499/11; H04S 1/00; H04S 7/301; H04S 7/304; H04S 2420/01
See application file for complete search history.

(56) References Cited

U.S. PATENT DOCUMENTS 5,742,689 A * 4/1998 Tucker ..... H04S 3/004 381/17
2008/0137870 A1* 6/2008 Nicol ..... H04S 1/002 381/17

FOREIGN PATENT DOCUMENTS

JP 2001-16697 A 1/2001
JP 2013-524711 A 6/2013
(Continued)

OTHER PUBLICATIONS

Iida et al., Median plane localization using a parametric model of the head-relatred transfer function based on spectral cues, Nov. 2006, whole document.*
(Continued)

*Primary Examiner* — Sonia Gay
(74) *Attorney, Agent, or Firm* — Nath, Goldberg & Meyer; Jerald L. Meyer; Stanley N. Protigal

(57) ABSTRACT

A measuring unit obtains a head-related impulse response of a user based on a sound signal which is collected by a microphone worn on an ear of the user in a state where a predetermined sound as a measurement signal is outputted from a speaker. A feature amount extraction unit extracts a feature amount of a frequency characteristic corresponding to the head-related impulse response. A characteristic selection unit selects a head-related transfer function from a database, where head-related transfer functions of many people are respectively made in association with feature amounts of head-related transfer functions, based on the extracted feature amount.

6 Claims, 10 Drawing Sheets

(51) Int. Cl.

| | |
|---|---|
| ***H04S 5/00*** | (2006.01) |
| ***H04S 5/02*** | (2006.01) |
| ***H04S 7/00*** | (2006.01) |

(52) U.S. Cl.
CPC ..... *H04S 7/301* (2013.01); *H04S 7/304* (2013.01); *H04R 2499/11* (2013.01); *H04S 2420/01* (2013.01)

(56) References Cited

FOREIGN PATENT DOCUMENTS

| | | | |
|---|---|---|---|
| JP | 2013-168924 | A | 8/2013 |
| JP | 2014-99797 | A | 5/2014 |
| JP | 2015-19360 | A | 1/2015 |

OTHER PUBLICATIONS

International Search Report form 237 dated Mar. 1, 2016 in corresponding International Application No. PCT/JP2016/052711.

* cited by examiner

FIG. 12

| MEASUREMENT EXAMPLE | HORIZONTAL ANGLE $\theta$ | ELEVATION ANGLE $\gamma$ | MEASUREMENT PATTERN | FEATURE AMOUNT USED FOR SELECTING HRTF | | | | |
|---|---|---|---|---|---|---|---|---|
| 1 | 0 | 0,30,60 | MP1 | FEATURE AMOUNT 1 | | | | |
| 2 | 0 | 0,30,60 | MP1 | FEATURE AMOUNT 1 | | | FEATURE AMOUNT 4 | FEATURE AMOUNT 5 |
| | −30,30 | 0 | MP2 | | | | | |
| 3 | −30 | 0,30,60 | MP3 | | FEATURE AMOUNT 2 | FEATURE AMOUNT 3 | | |
| | 30 | 0,30,60 | MP4 | | | | | |
| 4 | 0 | 0,30,60 | MP1 | FEATURE AMOUNT 1 | FEATURE AMOUNT 2 | FEATURE AMOUNT 3 | FEATURE AMOUNT 4 | FEATURE AMOUNT 5 |
| | −30,30 | 0 | MP2 | | | | | |
| | −30 | 0,30,60 | MP3 | | | | | |
| | 30 | 0,30,60 | MP4 | | | | | |

HEAD-RELATED TRANSFER FUNCTION SELECTION DEVICE, HEAD-RELATED TRANSFER FUNCTION SELECTION METHOD, HEAD-RELATED TRANSFER FUNCTION SELECTION PROGRAM, AND SOUND REPRODUCTION DEVICE

CROSS REFERENCE TO RELATED APPLICATION

This application is a Continuation of PCT Application No. PCT/JP2016/052711 filed on Jan. 29, 2016, and claims the priority of Japanese Patent Application No. 2015-081483 filed on Apr. 13, 2015, the entire contents of both of which are incorporated herein by reference.

BACKGROUND

The present disclosure relates to a head-related transfer function selection device, a head-related transfer function selection method, a head-related transfer function selection program capable of selecting a head-related transfer function similar to that of a user, and a sound reproduction device that can reproduce a sound signal using a head-related transfer function similar to that of the user.

When the user listens to a sound through headphones (earphones) reproducing a sound signal, a phenomenon called in-head localization, in which the user feels as if a sound is ringing in his or her head, is likely to occur. By utilizing a technique of localizing the sound using a head-related transfer function of a dummy head or the head of another user such that the user feels as if the sound is ringing outside his or her head, the phenomenon called in-head localization can be reduced.

SUMMARY

Characteristics of a head-related transfer function vary depending on the shape of the head or the auricle. Accordingly, it is desirable to localize a sound using a head-related transfer function of the user who wears headphones and listens to the sound such that the user feels as if the sound is ringing outside his or her read. However, it is not easy for the user to measure the head-related transfer function himself or herself in daily life.

A first aspect of the embodiment provides a head-related transfer function selection device including: a measuring unit configured to obtain a head-related impulse response of a user based on a sound signal which is collected by a microphone worn on an ear of the user in a state where a predetermined sound as a measurement signal is outputted from a speaker; a feature amount extraction unit configured to extract a feature amount of a frequency characteristic corresponding to the head-related impulse response; and a characteristic selection unit configured to select a head-related transfer function from a database, where head-related transfer functions of many people are respectively made in association with feature amounts of head-related transfer functions, based on the feature amount extracted by the feature amount extraction unit.

A second aspect of the embodiments provide a head-related transfer function selection method including: generating a predetermined sound as a measurement signal from a speaker; obtaining a head-related impulse response of a user based on a sound signal of the predetermined sound which is collected by a microphone worn on an ear of the user; extracting a feature amount of a frequency characteristic corresponding to the head-related impulse response; and selecting a head-related transfer function from a database, where head-related transfer functions of many people are respectively made in association with feature amounts of head-related transfer functions, based on the extracted feature amount.

A third aspect of the embodiment provides a head-related transfer function selection program stored in a non-transitory storage medium, the program allowing a computer to execute: a step of obtaining a head-related impulse response of a user based on a sound signal which is collected by a microphone worn on an ear of the user in a state where a predetermined sound as a measurement signal is outputted from a speaker; a step of extracting a feature amount of a frequency characteristic corresponding to the head-related impulse response; and a step of selecting a head-related transfer function from a database, where head-related transfer functions of many people are respectively made in association with feature amounts of head-related transfer functions, based on the extracted feature amount.

A fourth aspect of the embodiment provides a sound reproduction device including: a measuring unit configured to obtain a head-related impulse response of user based on a sound signal which is collected by a microphone worn on an ear of the user in a state where a predetermined sound as a measurement signal is outputted from a speaker; a feature amount extraction unit configured to extract a feature amount of a frequency characteristic corresponding to the head-related impulse response; a characteristic selection unit configured to select a head-related transfer function from a database, where head-related transfer functions of many people are respectively made in association with feature amounts of head-related transfer functions, based on the feature amount extracted by the feature amount extraction unit; and a reproduction unit configured to perform a convolution operation sound data with the head-related transfer function selected by the characteristic selection unit, and to reproduce the sound data.

BRIEF DESCRIPTION OF THE DRAWINGS

FIG. 12 is a table collectively illustrating the first to fourth measurement examples.

DETAILED DESCRIPTION

Hereinafter, a head-related transfer function selection device, a head-related transfer function selection method, a head-related transfer function selection program, and a sound reproduction device according to the embodiment will be described with reference to the accompanying drawings.

Overall Configuration of Head-Related Transfer Function Selection Device and Sound Reproduction Device First, the overall configuration of the head-related transfer function selection device and the sound reproduction device according to the embodiment will be described with reference to FIG. 1.

Figure 1:
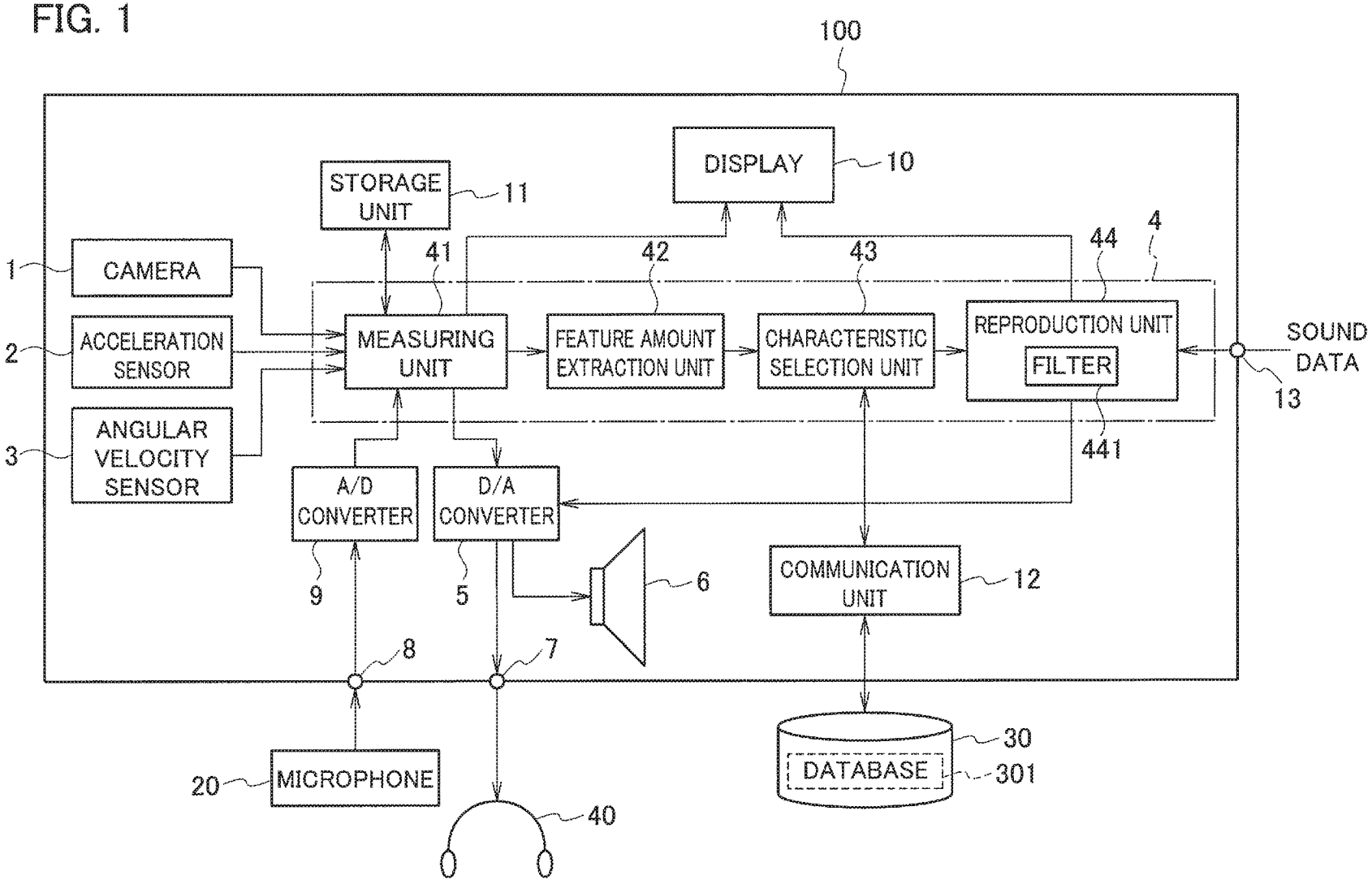
FIG. 1 is block diagram illustrating a head-related transfer function selection device and a sound reproduction device according to at least one embodiment.

In FIG. 1, a general-purpose portable terminal 100 functions as a head-related transfer function selection device and a sound reproduction device. For example, the portable terminal 100 may be a mobile phone such as smartphone.

The portable terminal 100 includes a camera an acceleration sensor 2, and an angular velocity sensor 3. The camera 1, the acceleration sensor 2, and the angular velocity sensor 3 are connected to a controller 4 which is configured by, for example, a CPU. The controller 4 includes a measuring unit 41, a feature amount extraction unit 42, a characteristic selection unit 43, and a reproduction unit 44.

An image signal obtained by the camera 1 capturing an object is inputted to the measuring unit 41 and then is supplied from the measuring unit 41 to the display 10 to display an image. When the user performs a predetermined operation through an operation unit (not illustrated), the camera 1 may capture the object to generate the image signal.

An acceleration detection signal detected by the acceleration sensor 2 and an angular velocity detection signal, which represents the tilt or angle of the portable terminal 100, detected by the angular velocity sensor 3 are inputted to the measuring unit 41. The acceleration sensor 2 and the angular velocity sensor 3 may operate at all times in a state where power is supplied to the portable terminal 100.

The measuring unit 41 can generate digital sound data which is a predetermined measurement signal for measuring a head-related impulse response (HRIR) of the user. When the user performs a predetermined operation through the operation unit, the measuring unit 41 supplies the digital sound data to a D/A converter 5.

The D/A converter 5 converts the digital sound data into an analog sound signal, and supplies the converted analog sound signal to a speaker 6. The speaker 6 may be a built-in speaker of the portable terminal 100. As the speaker 6, an external speaker may be used. The speaker 6 may be a monaural speaker or a stereo speaker.

Headphones 40 may be attached to a sound signal output terminal 7. The way to use the headphones 40 will be described below.

A microphone 20 is connected to a microphone connection terminal 8. It is preferable that the microphone 20 is an earphone-type microphone which is wearable on the auricle of the user. The microphone 20 may be a monaural microphone or a stereo microphone. In the embodiment, the microphone 20 is a monaural microphone.

When a sound is outputted from the speaker 6 in a state where the user positions the portable terminal 100 in front of the face of the user as described below, the microphone 20 collects the sound. An analog sound signal outputted from the microphone 20 is inputted to an A/D converter 9 through the microphone connection terminal 8. The A/D converter 9 converts the analog sound signal into digital sound data, and supplies the converted digital sound data to the measuring unit 41.

The digital sound data inputted to the measuring unit 41 represents the HRIR of the user which varies depending on the shape of the head or auricle of the user.

The measuring unit 41 obtains HRIRs when the portable terminal 100 is positioned at a plurality of positions, and temporarily stores the obtained HRIRs in a storage unit 11. The HRIRs stored in the storage unit 11 are inputted to the feature amount extraction unit 42.

The feature amount extraction unit 42 transforms the inputted HRIRs to generate head-related transfer functions (HRTFs) by using Fourier transformation. After the transformation of the HRIRs into the HRTFs, the measuring unit 41 may store the HRTFs in the storage unit 11.

The feature amount extraction unit 42 extracts a feature amount from the HRTF of the user. The details of the feature amount will be described below. The feature amount extracted by the feature amount extraction unit 42 is inputted to the characteristic selection unit 43.

An external server 30 stores a database 301 where HRTFs of many people are respectively made in association with feature amounts of HRTFs described below. The characteristic selection unit 43 accesses a server 30 through a communication unit 12, and selects an HRTF having a feature amount, which is most similar to the feature amount extracted by the feature amount extraction unit 42, from the database 301.

The selected HRTF is inputted to the characteristic selection unit 43 through the communication unit 12. The selected HRTF is substantially the same as the HRTF of the user. The characteristic selection unit 43 supplies the HRTF to the reproduction unit 44.

The database 301 may be built in the portable terminal 100 in advance. The portable terminal 100 may access the server 30, read data of the database 301, and store the same data as that of the database 301 in the storage unit 11 or another storage unit (not illustrated).

Digital sound data to be reproduced by the portable terminal 100 is inputted from an external device to the reproduction unit 44 through a sound signal input terminal 13. Digital sound data stored in the storage unit, which is built in the portable terminal 100, may be inputted to the reproduction unit 44. In case where an analog sound signal is inputted from an external device, the analog sound signal may be converted into digital sound data by the A/D converter 9 or another A/D converter such that the converted digital sound data is supplied to the reproduction unit 44.

The reproduction unit 44 includes a filter 441 that performs a HRTF convolution operation with the digital sound data. The filter 441 performs the HRTF convolution operation with the inputted digital sound data selected by the characteristic selection unit 43 and supplies the convolved data to the D/A converter 5. The D/A converter 5 converts the digital sound data, which is supplied from the reproduction unit 44, into an analog sound signal.

The analog sound signal outputted from the D/A converter 5 is supplied to the headphones 40 through the sound signal output terminal 7. The headphones 40 are an arbitrary type of headphones such as an overhead type, an inner ear type, or a canal type. Examples of the headphones described herein include earphones. The headphones 40 and the microphone 20 may be integrated.

The user wears the headphones 40 on his or her head or the auricle and listens to a sound which is generated based on the analog sound signal outputted from the sound signal output terminal 7. Since substantially the same HRTF as that of the user is convolved by the filter 441, the user can listen to the sound which is localized outside the head in a state where the sound is adjusted to be suitable for the user.

In addition, the user can listen to the sound in a state where the user feels as if left and right sounds are ringing in predetermined angular directions as described below.

Specific measurement examples for measuring the HRIR of the user will be sequentially described.

First Measurement Example

The first measurement example will be described using a flowchart illustrated in FIG. 2. The flowchart illustrated in FIG. 2 or a flowchart described below includes a step regarding an operation which is performed by the user, and a step regarding a process which is performed in the portable terminal 100.

Figure 2:
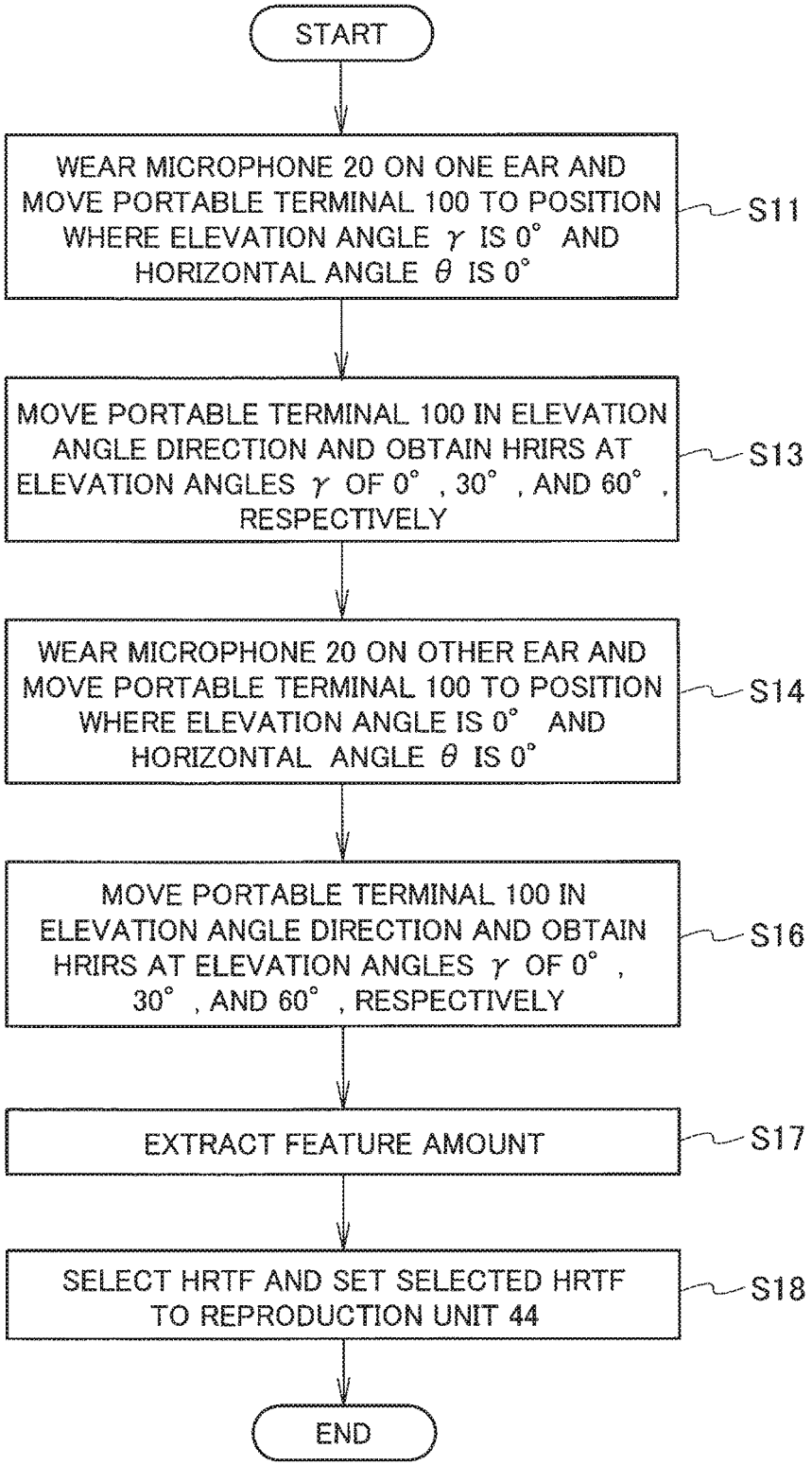
FIG. 2 is a flowchart illustrating the first measurement example for measuring a head-related impulse response of a user.

In step S11 of FIG. 2, the user he user wears the microphone 20 on one ear and moves the portable terminal 100 to a position where the elevation angle γ is 0° and the horizontal angle θ is 0°.

Figure 3:
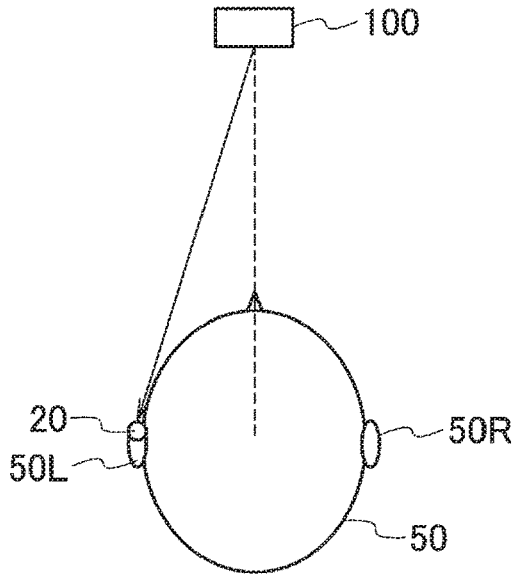
FIG. 3 is a schematic diagram illustrating a state where a portable terminal is moved to a position in front of a face where a horizontal angle is 0° and an elevation angle is 0°.

Specifically, as illustrated in FIG. 3, the user wears the microphone 20 on the left ear 50L, and moves the portable terminal 100 in front of the head 50 (face), for example. It is assumed that, in a state where the portable terminal 100 is positioned in front of the face, the horizontal angle θ is 0°.

In addition, in order to verify that the portable terminal 100 is correctly positioned at a desired position, the position of the portable terminal may be adjusted using an image obtained by the camera 1, information obtained by the acceleration sensor 2, and the angular velocity sensor 3 so as to be positioned in front of the face.

Figure 4:
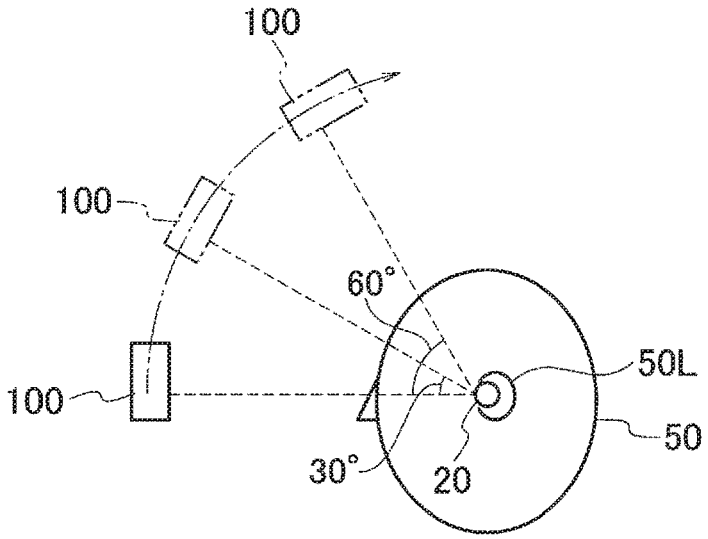
FIG. 4 is a schematic diagram illustrating a state where the portable terminal is moved from a position where the elevation angle is 0° to positions where the elevation angles are 30° and 60°, respectively.

When the portable terminal 100 is moved around the center of the head 50 in an arc shape and in a vertical direction as illustrated in FIG. 4, the angle in the vertical direction is set as the elevation angle γ. It is assumed that, in a state where the user moves the portable terminal 100 to a position at the height of the left ear 50L or the right eye 50R, the elevation angle γ is 0°.

The position of the portable terminal 100 indicated by a solid line in FIGS. 3 and 4 is a setting position of the portable terminal 100 in step S11.

In step S13, the user moves the portable terminal 100 from the position where the elevation angle γ is 0° to positions where the elevation angles γ are 30° and 60°, respectively, in a state where the sound of the measurement signal is outputted from the speaker 6. At this time, the measuring unit 41 obtains HRIRs at the elevation angles γ of 0°, 30°, and 60°, respectively.

The image signal obtained by camera 1 capturing the object, the acceleration detection signal outputted from the acceleration sensor 2, and the angular velocity detection signal outputted from the angular velocity sensor 3 are inputted to the measuring unit 41. Accordingly, the measuring unit 41 may obtain the HRIRs when the portable terminal 100 is moved to the positions where the elevation angles γ are 0°, 30°, and 60°, respectively.

It is not necessary for the user to pay special attention to the elevation angle γ, and it is sufficient that the user moves the portable terminal 100 in the vertical direction to a position where the elevation angle γ is in a range of 0° to 60°. At this time, in a case where deviation of the portable terminal 100 from the moving path during the measurement is detected, based on the image obtained from the camera 1 and the information obtained from the acceleration sensor 2 and the angular velocity sensor 3, the path may be corrected through a process of displaying the correct path on the display 10, for example.

Next, in step S14, the user wears the microphone 20 on the other ear and moves the portable terminal 100 to a position where the elevation angle γ is 0° and the horizontal angle θ is 0°.

In step S16, the user moves the portable terminal 100 from the position where the elevation angle γ is 0° to positions where the elevation angles γ are 30° and 60°, respectively, in a state where the sound of the measurement signal is outputted from the speaker 6. At this time, the measuring unit 41 obtains HRIRs at the elevation angles γ of 0°, 30°, and 60°, respectively.

Figure 5:
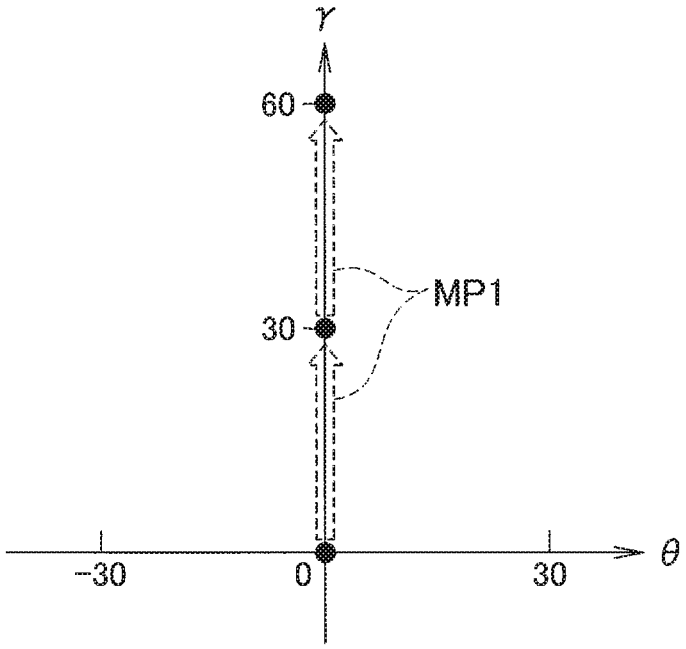
FIG. 5 is a diagram illustrating a measurement pattern obtained from the first measurement example.

A measurement pattern obtained from the first measurement example is the measurement pattern MP1 illustrated in FIG. 5. The elevation angles of 0°, 30°, and 60° are merely examples. Another elevation angle may be adopted, and the number of elevation angles γ is not limited to three. The number of elevation angles γ is preferably two or more.

In step S17, the feature amount extraction unit 42 extracts a feature amount of an HRIR. For example, the feature amount extraction unit 42 may extract a feature amount of an HRIR as follows.

Figure 6:
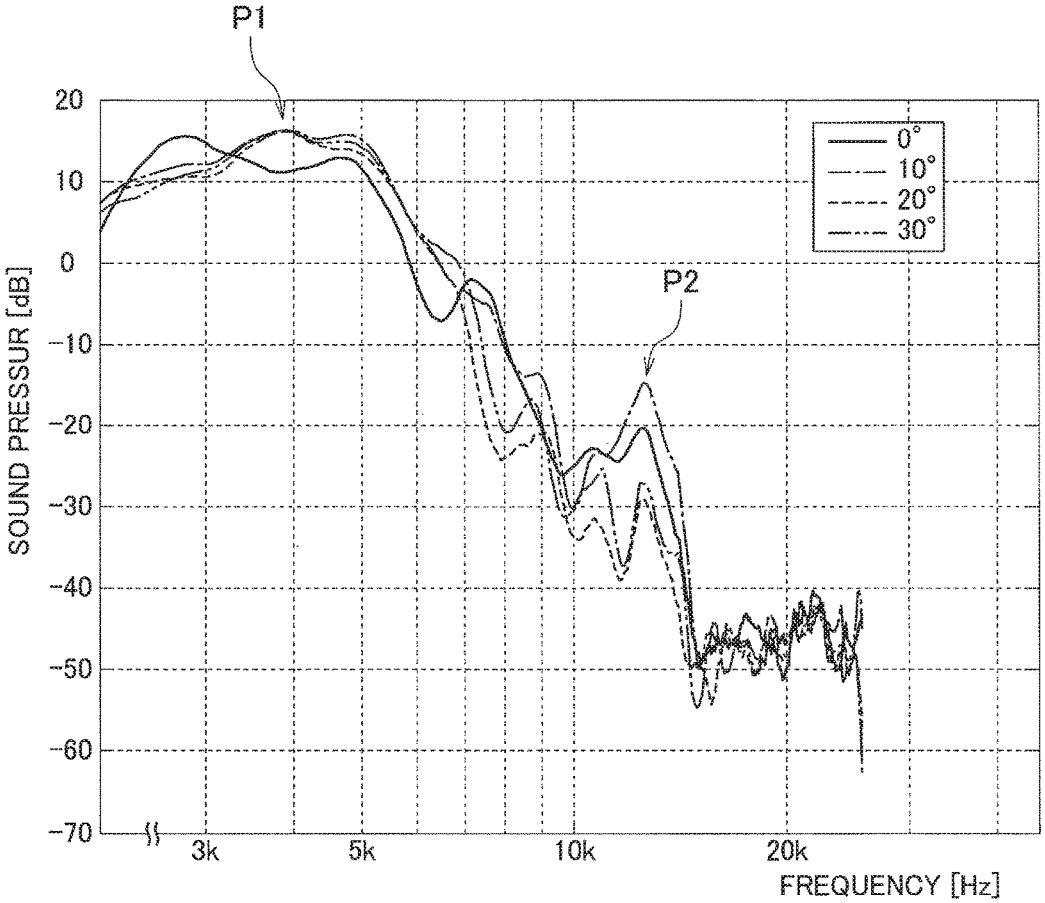
FIG. 6 is a characteristic diagram illustrating head-related transfer functions when a sound of a measurement signal is outputted from a speaker in a dead-sound chamber at the horizontal angle of 0° and at different elevation angles.

In FIG. 6, a characteristic indicated by a solid line shows an HRTF which is measured when a sound of a measurement signal is outputted from the speaker 6 in a dead-sound chamber at a horizontal angle θ of 0° and an elevation angle γ of 0°. A characteristic indicated by a one-dot chain line shows an HRTF which is measured when a sound of a measurement signal is outputted from the speaker 6 in a dead-sound chamber at a horizontal angle θ of 0° and an elevation angle γ of 10°.

The characteristics of the HRTFs illustrated in FIG. 6 vary depending on the shape of the head of an individual and the shape of an ear thereof. Massachusetts Institute of Technology or Itakura Laboratory at Nagoya University et al. release a database of HRTFs measured at incidence angles in whole directions on the Internet.

FIG. 6 is a diagram illustrating measurement data of a specific test subject at a horizontal angle of 0° and elevation angles of 0° to 30° which is obtained from the database of HRTFs measured in a dead-sound chamber which are released by Advanced Acoustic Information Systems, Research Institute of Electrical Communication, Tohoku University (http://www.ais.riec.tohoku.ac.jp/lab/db-hrtf/index-j.html).

A characteristic indicated by a broken line shows an HRTF which is measured when a sound of a measurement signal is outputted from the speaker 6 in a dead-sound chamber at a horizontal angle θ of 0° and an elevation angle γ of 20°. A characteristic indicated by a two-dot chain line shows an HRTF which is measured when a sound of a measurement signal is outputted from the speaker 6 in a dead-sound chamber at a horizontal angle θ of 0° and an elevation angle γ of 30°.

As illustrated in FIG. 6, frequencies of a local peak P2 in a frequency range of 10 kHz to 20 kHz are substantially the same at the elevation angles γ of 0° to 30°. Here, frequencies of the peak P2 are also substantially the same at elevation angles γ of 30° to 60° (not illustrated).

When the present inventors inspected measurement data of other test subjects and created a graph with reference to the above-described database, the following was found. When the same test subject was inspected, the frequencies of the peak P2 were the same or substantially the same at the elevation angles γ of 0° to 30°. On the other hand, when different test subjects were compared to each other, the frequencies of the peak P2 were different from each other at the elevation angles 0° to 30°. Therefore, the feature amount extraction unit 42 extracts the frequencies of the peak P2 as a feature amount of an HRTF of an individual user.

In addition to the frequencies of the peak P2, the feature amount extraction unit 42 may extract a variation in the amplitude of the peak P2 corresponding to the elevation angle γ as a feature amount of an HRTF.

A feature amount of an HRTF measured by the measurement pattern MP1 of FIG. 5 will be called "feature amount 1". In the database 301, HRTFs of many people are respectively made in association with at least feature amounts 1.

Returning to FIG. 2, in step S18, the characteristic selection unit 43 selects an HRTF having a feature amount, which is most similar to the feature amount 1 extracted by the feature amount extraction unit 42, from the database 301, sets the selected HRTF to the reproduction unit 44, and ends the process.

For example, the HRTF is data of HRTF (θ,0) and HRTF (−θ,0) for localizing left and right sounds in directions of horizontal angles ±74° at an elevation angle γ. The horizontal angle θ° is 30°, for example.

Second Measurement Example

Figure 7:
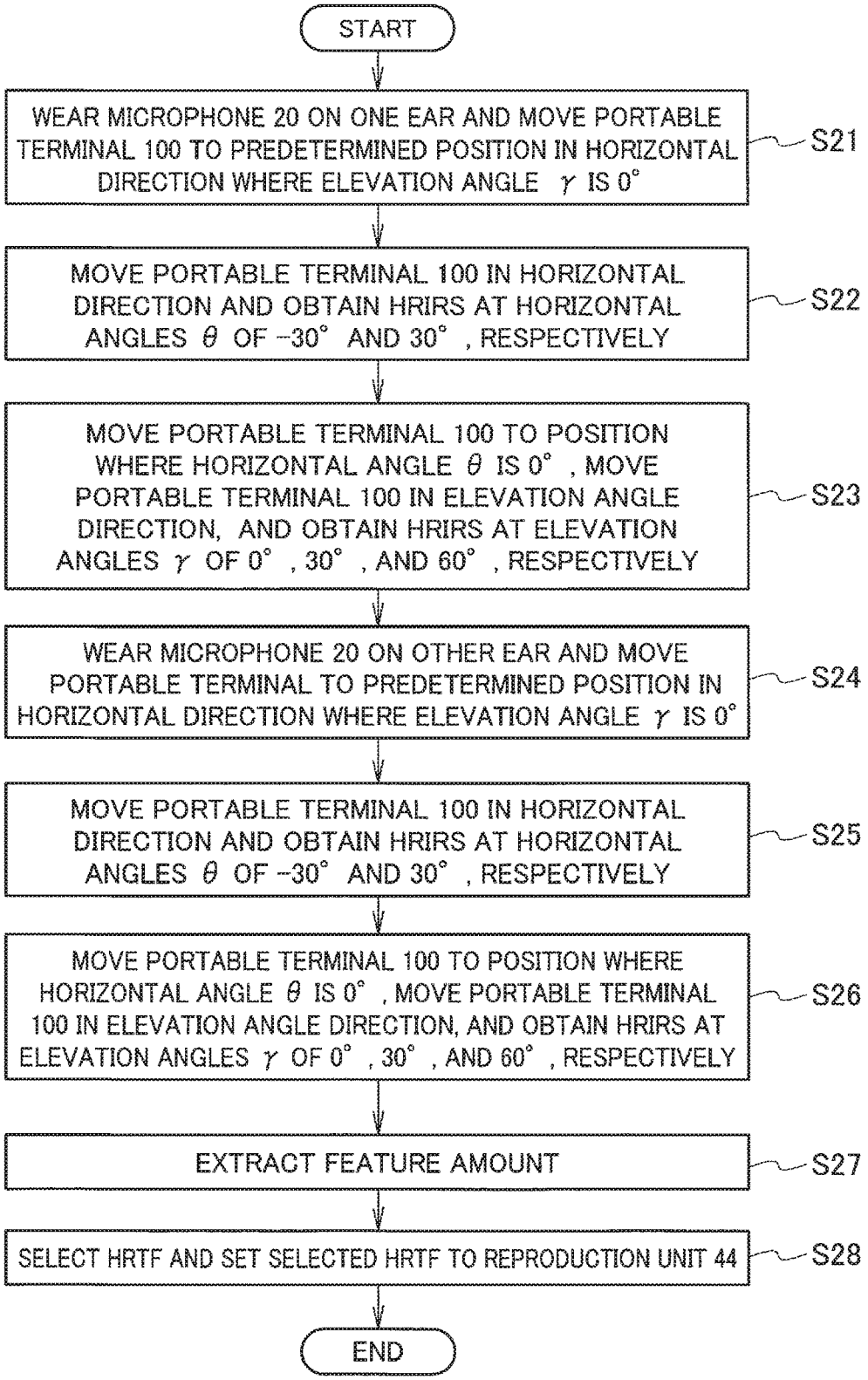
FIG. 7 is a flowchart illustrating the second measurement example for measuring a head-related impulse response of a user.

The second measurement example will be described using a flowchart illustrated in FIG. 7. In step S21 of FIG. 7, the user wears the microphone 20 on one ear and moves the portable terminal 100 to a predetermined position in the horizontal direction where the elevation angle γ is 0°.

Figure 8:
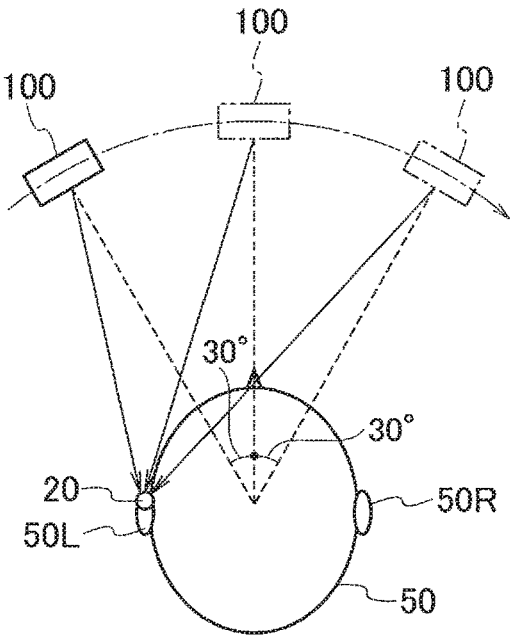
FIG. 8 is a schematic diagram illustrating a state where the portable terminal is moved from a position where the horizontal angle is −30° to positions where the horizontal angles are 0° and 30°, respectively.

Specifically, as illustrated in FIG. 8, the user wears the microphone 20 on the left ear 50L, for example, and moves the portable terminal 100 to the left side with respect to the front of the head 50 (face), for example. In the second measurement example, as in the first measurement example, in order to verify that the portable terminal 100 is correctly positioned at a desired position, the position of the portable terminal may be adjusted using the image obtained by the camera 1, the information obtained by the acceleration sensor 2, and the angular velocity sensor 3, so as to be positioned in front of the face.

In step S22, in a state where a sound of a measurement signal is outputted from the speaker 6, the user moves the portable terminal 100 around the center of the head 50 in an arc shape in the horizontal direction as indicated by a two-dot chain line in FIG. 8. At this time, the measuring unit 41 obtains HRIRs at the horizontal angles θ of −30° and 30°.

Here, similarly, the image signal obtained by camera 1 imaging the object, the acceleration detection signal outputted from the acceleration sensor 2, and the angular velocity detection signal outputted from the angular velocity sensor 3 are inputted to the measuring unit 41. Accordingly, the measuring unit 41 may obtain the HRIRs when the portable terminal 100 is moved to the positions where the horizontal angles θ are −30° and 30°, respectively.

It is not necessary for the user to pay special attention to the horizontal angle θ, and it is sufficient that the user moves the portable terminal 100 in the horizontal direction to a position where the horizontal angle θ is in a range of −30° to 30°.

Next, in step S23, the user moves the portable terminal 100 to a position where the horizontal angle θ is 0° in a state where the sound of the measurement signal is outputted from the speaker 6, and then moves the portable terminal 100 from a position where the elevation angle γ is 0° to positions where the elevation angles γ are 30° and 60°, respectively. At this time, the measuring unit 41 obtains HRIRs at the elevation angles γ of 0°, 30°, and 60°, respectively.

Next, in step S24, the user wears the microphone 20 on the other ear and, as in the case of step S21, moves the portable terminal 100 to a predetermined position in the horizontal direction where the elevation angle γ is 0°.

In step S25, in a state where the sound of the measurement signal is outputted from the speaker 6, the user moves the portable terminal 100 around the center of the head 50 in an arc shape in the horizontal direction. At this time, the measuring unit 41 obtains HRIRs at the horizontal angles θ of −30° and 30°.

Next, in step S26, the user moves the portable terminal 100 to a position where the horizontal angle θ is 0° in a state where the sound of the measurement signal is outputted from the speaker 6, and then moves the portable terminal 100 from a position where the elevation angle γ is 0° to positions where the elevation angles γ are 30° and 60°, respectively. At this time, the measuring unit 41 obtains HRIRs at the elevation angles γ of 0°, 30°, and 60°, respectively.

In the second measurement example, as in the first measurement example, in a case where deviation of the portable terminal 100 from the moving path during the measurement is detected based on the image obtained from the camera 1 and the information obtained from the acceleration sensor 2 and the angular velocity sensor 3, the path may be corrected through a process of displaying a correct path on the display 10, for example.

Figure 9:
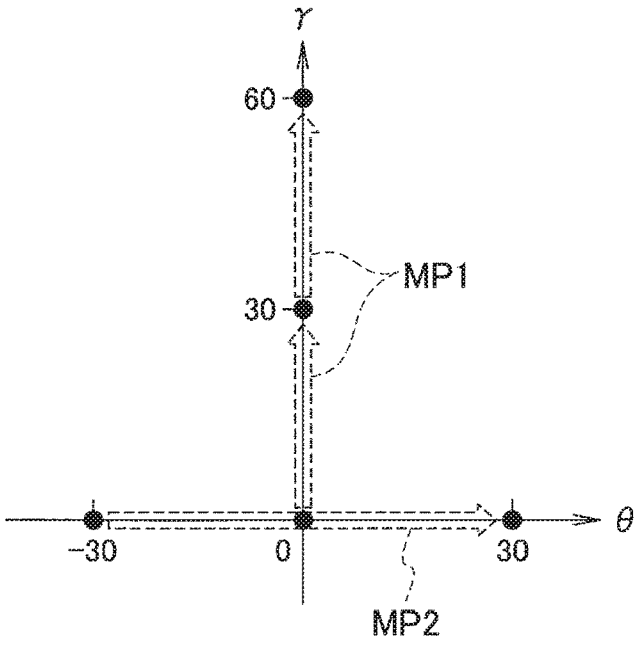
FIG. 9 is a diagram illustrating measurement patterns obtained from the second measurement example.

Measurement patterns obtained from the second measurement example are the measurement pattern MP1 and a measurement pattern MP2 illustrated in FIG. 9. In FIG. 7, the measurement using the measurement pattern MP1 is performed after the measurement using the measurement pattern MP2, but the order may be reversed.

Likewise, the elevation angles γ of 0°, 30°, and 60° are merely examples. Another elevation angle may be adopted, and the number of elevation angles γ is not limited to three. The number of elevation angles γ is preferably two or more. The horizontal angle θ is not limited to −30° and 30°.

In step S27, the feature amount extraction unit 42 extracts a feature amount of an HRTF. For example, the feature amount extraction unit 42 may extract a feature amount of an HRIR as follows.

When the horizontal angle γ is −30° in the measurement pattern MP2 of FIG. 9, the frequencies of the peak 2 will be called a feature amount 4. When the horizontal angle θ is 30° in the measurement pattern MP2 of FIG. 9, the frequencies, of the peak 2 will be called a feature amount 5. In the database 301, HRTFs of many people are respectively made in association with at least feature amounts 1, 4, and 5.

Frequencies of a peak P1 at about 4 kHz in FIG. 6 as a feature amount may be added to the feature amounts 4 and 5. The frequencies of the peak P1 vary depending on the individual people. Therefore, the frequencies of the peak P1 can be set as a feature amount of an HRTF of an individual user. An amplitude value of the peak P1 may be added as a feature amount of an HRIR.

Returning to FIG. 7, in step S28, the characteristic selection unit 43 selects an HRTF having feature amounts, which are most similar to the feature amounts 1, 4, and 5 extracted by the feature amount extraction unit 42, from the database 301, sets the selected HRTF to the reproduction unit 44, and ends the process.

Specific data of the HRTF is the same as that of the first measurement example. For example, the HRTF is data of HRTF (θ,0) and HRTF (−θ,0) for localizing left and right sounds in directions of horizontal angles ±θ° at an elevation angle γ. The horizontal angle θ° is 30°, for example.

Third Measurement Example

Figure 10:
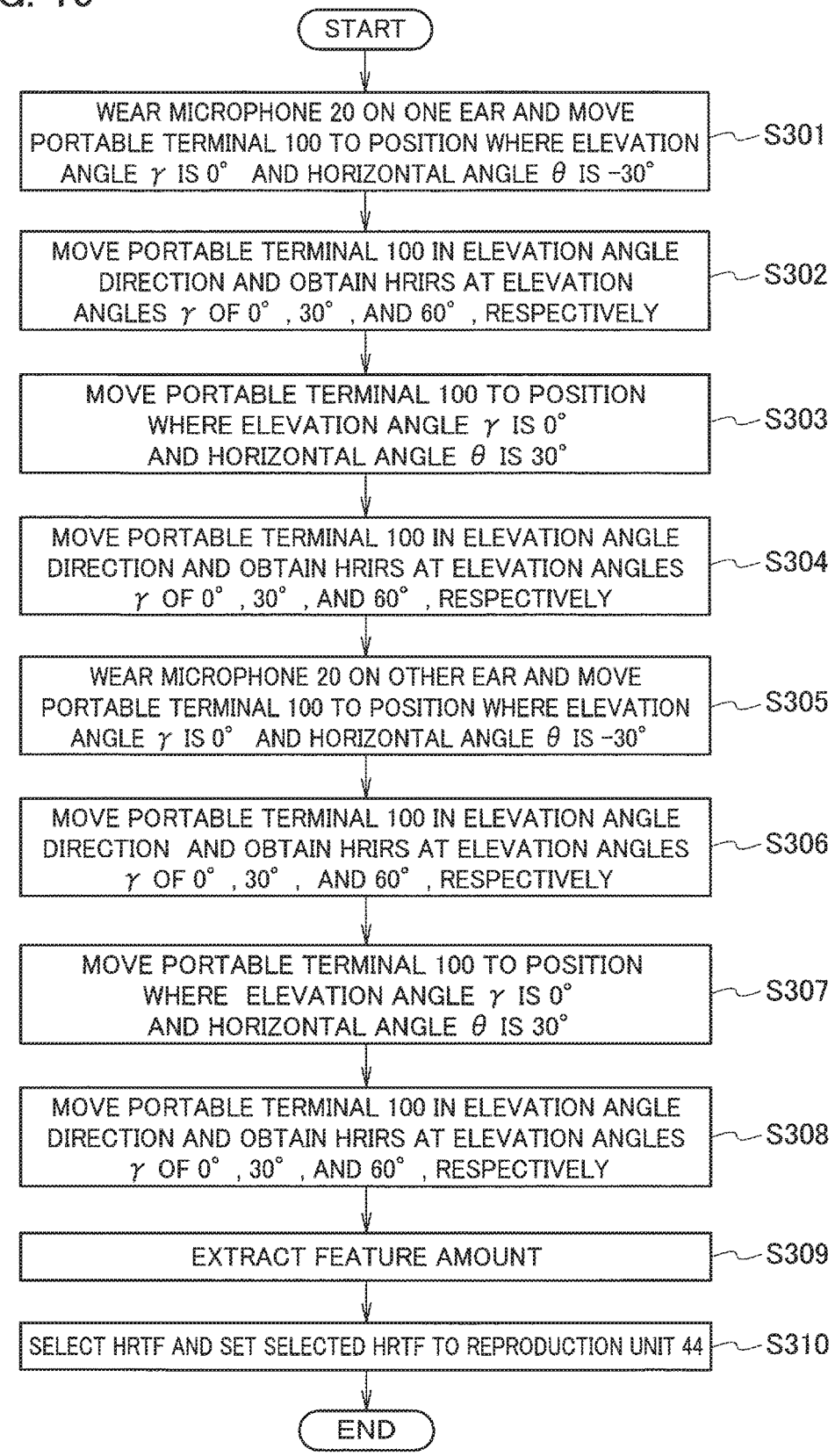
FIG. 10 is a flowchart illustrating the third measurement example for measuring a head-related impulse response of a user.

The third measurement example will be described using a flowchart illustrated in FIG. 10. In step S301 of FIG. 10, the user wears the microphone 20 on one ear and moves the portable terminal 100 to a position where an elevation angle γ is 0° and a horizontal angle θ is −30°.

A position of the portable terminal 100 indicated by a solid line in FIG. 8 is a setting position of the portable terminal 100 in step S301. In the third measurement example, as in the first or second measurement example, in order to verify that the portable terminal 100 is correctly positioned at a desired position, the position of the portable terminal may be adjusted using the image obtained by the camera 1, the information obtained by the acceleration sensor 2, and the angular velocity sensor 3 so as to be positioned in front of the face.

In step S302, in a state where the sound of the measurement signal is outputted from the speaker 6, the user moves the portable terminal 100 in the elevation angle direction. At this time, the measuring unit 41 obtains HRIRs at the elevation angles γ of 0°, 30°, and 60°, respectively.

Next, in step S303, the user moves the portable terminal 100 to a position where the elevation angle γ is 0° and the horizontal angle θ is 30°.

In step S304, in a state where the sound of the measurement signal is outputted from the speaker 6, the user moves the portable terminal 100 in the elevation angle direction. At this time, the measuring unit 41 obtains HRIRs at the elevation angles γ of 0°, 30°, and 60°, respectively.

Next, in step S305, the user wears the microphone 20 on the other ear and, as in the case of step S301, moves the portable terminal 100 to a position where the elevation angle γ is 0° and the horizontal angle θ is −30°.

In step S306, in a state where the sound of the measurement signal is outputted from the speaker 6, the user moves the portable terminal 100 in the elevation angle direction. At this time, the measuring unit 41 obtains HRIRs at the elevation angles γ of 0°, 30°, and 60°, respectively.

Next, in step S307, the user moves the portable terminal 100 to a position where the elevation angle γ is 0° and the horizontal angle θ is 30°.

In step S308, in a state where the sound of the measurement signal is outputted from the speaker 6, the user moves the portable terminal 100 in the elevation angle direction. At this time, the measuring unit 41 obtains HRIRs at the elevation angles of 0°, 30°, and 60°, respectively.

In the third measurement example, as in the first or second measurement example, in a case where deviation of the portable terminal 100 from the moving path during the measurement is detected based on the image obtained from the camera 1 and the information obtained from the acceleration sensor 2 and the angular velocity sensor 3, the path may be adjusted through a process of displaying a correct path on the display 10, for example.

Figure 11:
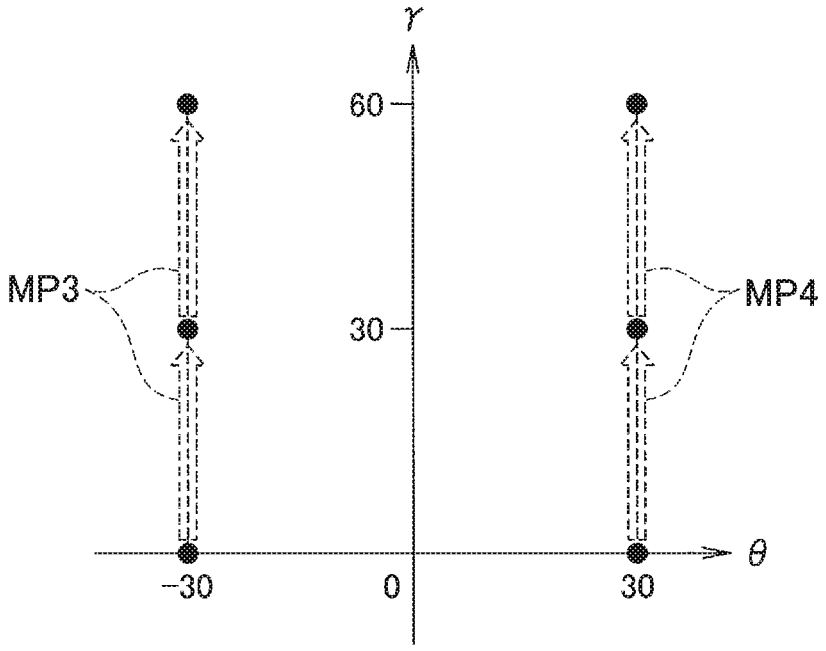
FIG. 11 is a diagram illustrating measurement patterns obtained from the third measurement example.

Measurement patterns obtained from the third measurement example are measurement patterns MP3 and MP4, as illustrated in FIG. 11. In FIG. 10, the measurement using the measurement pattern MP4 is performed after the measurement using the measurement pattern MP3, but the order may be reversed.

Likewise, the elevation angles γ of 0°, 30°, and 60° are merely examples. Another elevation angle may be adopted, and the number of elevation angles γ is not limited to three. The number of elevation angles γ is preferably two or more. The horizontal angle θ is not limited to −30° and 30°.

In step S309, the feature amount extraction unit 42 extracts a feature amount of an HRTF. For example, the feature amount extraction unit 42 may extract a feature amount of an HRIR as follows.

When the horizontal angle θ is −30° and the elevation angles γ are 0°, 30°, and 60° in the measurement pattern MP3 of FIG. 11, the frequencies of the peak 2 will be called a feature amount 2. When the horizontal angle θ is 30° and the elevation angles γ are 0°, 30°, and 60° in the measurement pattern MP4 of FIG. 11, the frequencies of the peak 2 will be called a feature amount 3.

In the database 301, HRTFs of many people are respectively made in association with at least feature amounts 2 and 3.

In addition to the frequencies of the peak P2, the feature amount extraction unit 42 may extract a variation in the amplitude of the peak P2 corresponding to the elevation angle γ as a feature amount of an HRTF.

Returning to FIG. 10, in step S310, the characteristic selection unit 43 selects an HRTF having feature amounts, which are most similar to the feature amounts 2 and 3 extracted by the feature amount extraction unit 42, from the database 301, sets the selected HRTF to the reproduction unit 44, and ends the process.

Specific data of the HRTF is similar to that of the first measurement example. For example, the HRTF is data of HRTF (θ,0) and HRTF (−θ,0) for localizing the left and right sounds in directions of horizontal angles ±θ° at an elevation angle γ. The horizontal angle θ° is 30°, for example.

As the data of HRTF (θ,0) and HRTF (−θ,0), the characteristic selection unit 43 does not necessarily select a pair of data stored in the database 301. HRTF (θ,0) of one pair of data HRTF (θ,0) and HRTF (−θ,0) stored in the database 301 may be combined with HRTF (−θ,0) of another pair of data HRTF (θ,0) and HRTF (−θ,0).

In the third measurement example, the feature amount 2 obtained from the measurement pattern MP3 of FIG. 11 and the feature amount 3 obtained from the measurement pattern MP4 of FIG. 11 are used, but the feature amounts 4 and 5 in the second measurement example may be added thereto.

Fourth Measurement Example

The user may perform the fourth measurement example for measuring all the above-described measurement patterns MP1 to MP4. In this case, in the database 301, HRTFs of many people are respectively made in association with the feature amounts 1 to 5.

The characteristic selection unit 43 selects an HRTF having feature amounts, which are most similar to the feature amounts 1 to 5 extracted by the feature amount extraction unit 42, from the database 301, and sets the selected HRTF to the reproduction unit 44.

FIG. 12 collectively illustrates the above-described first to fourth measurement examples. As illustrated in FIG. 12, in the first measurement example, in order to select the HRTF, the feature amount 1 obtained from the measurement pattern MP1 where the horizontal angle θ is 0° and the elevation angles γ are 0°, 30°, and 60° is used.

In the second measurement example, in order to select the HRTF, the feature amount 1 obtained from the measurement pattern MP1 where the horizontal angle θ is 0° and the elevation angles γ are 0°, 30°, and 60°, and the feature amounts 4 and 5 obtained from the measurement pattern MP2 where the horizontal angles θ are −30° and 30° and the elevation angle γ is 0° are used.

In the third measurement example, in order to select the HRTF, the feature amount 2 obtained from the measurement pattern MP3 where the horizontal angle θ is −30° and the elevation angles γ are 0°, 30°, and 60°, and the feature amount 3 obtained from the measurement pattern MP4 where the horizontal angle θ is 30° and the elevation angles γ are 0°, 30°, and 60° are used.

In the fourth measurement example, in order to select the HRTF, the feature amounts 1 to 5 obtained from the measurement patterns MP1 to MP4 are used.

As the number of measurement patterns increases, it becomes easier to extract the feature amounts. Accordingly, the second or third measurement example is preferable to the first measurement example, and the fourth measurement example is most preferable. However, as the number of measurement patterns increases, the measurement becomes more complicated.

As described above, the head-related transfer function selection device according to the embodiment includes the measuring unit 41, the feature amount extraction unit 42, and the characteristic selection unit 43.

The measuring unit 41 obtains a head-related impulse response of a user based on a sound signal which is collected by the microphone 20 worn on an ear of the user in a state where a predetermined sound as a measurement signal is outputted from the speaker 6.

The feature amount extraction unit 42 extracts a feature amount of frequency characteristic corresponding to the head-related impulse response. The characteristic selection unit 43 selects a head-related transfer function from the database 301, where head-related transfer functions of many people are respectively made in association with feature amounts of head-related transfer functions, based on the feature amount extracted by the feature amount extraction unit 42.

It is assumed that, in a state where the speaker 6 (portable terminal 100) is positioned in front of the face of the user, the horizontal angle θ is 0° and the elevation angle γ is 0°. The measuring unit 41 preferably obtains a plurality of head-related impulse responses when the speaker 6 is moved to a position where the horizontal angle θ is 0° or a predetermined positive or negative value, and then is moved in an arc shape in a vertical direction to positions where the elevation angles γ are a plurality of values, respectively.

The feature amount extraction unit 42 preferably extracts feature amounts based on frequency characteristics corresponding to the head-related impulse responses.

The measuring unit 41 may further obtain a plurality of head-related impulse responses when the speaker 6 is moved to positions where the elevation angles γ are 0° and the horizontal angles θ are predetermined positive and negative values, respectively.

The head-related transfer function selection method according to the embodiment includes: generating a predetermined sound as a measurement signal from the speaker 6; and obtaining a head-related impulse response of a user based on a sound signal of the predetermined sound which is collected by the microphone 20, worn on an ear of the user.

The head-related transfer function selection method according to the embodiment includes: extracting a feature amount of a frequency characteristic corresponding to the head-related impulse response; and selecting a head-related transfer function from a database, where head-related transfer functions of many people are respectively made in association with feature amounts of head-related transfer functions, based on the extracted feature amount.

In accordance with the head-related transfer function selection device and the head-related transfer function selection method according to the embodiment, a head-related transfer function similar to that of the user himself/herself can be easily selected.

A part of the measuring unit 41, the feature amount extraction unit 42, and the characteristic selection unit 43 may be configured by a computer program (head-related transfer function selection program). A part of the reproduction unit 44 may be configured by a computer program. The computer program may be stored in a computer-readable non-transitory storage medium, or may be provided through an arbitrary communication line such as the internet. The computer program may be a program product.

The head-related transfer function selection program according to the embodiment allows a computer to execute a step of obtaining a head-related impulse response of a user based on a sound signal which is collected by the microphone 20, worn on an ear of the user in a state where a predetermined sound as a measurement signal is outputted from the speaker 6.

The head-related transfer function selection program according to the embodiment allows a computer to execute a step of extracting a feature amount of a frequency characteristic corresponding to the head-related impulse response.

The head-related transfer function selection program according to the embodiment allows a computer to execute a step of selecting a head-related transfer function from the database 301, where head-related transfer functions of many people are respectively made in association with feature amounts of head-related transfer functions, based on the extracted feature amount.

In the head-related transfer function selection program according to the embodiment, a head-related transfer function similar to that of the user himself/herself can be easily selected, and a localization effect similar to characteristics of the user himself/herself can be easily realized.

The sound reproduction device according to the embodiment includes: the head-related transfer function selection device according to the embodiment; and the reproduction unit 44 that performs the convolution operation sound data with the head-related transfer function selected by the characteristic selection unit 43 and reproduces the sound data. Accordingly, in accordance with the sound reproduction device according to the embodiment, a sound signal can be reproduced using a head-related transfer function similar to that of the user himself/herself.

The present invention is not limited to the above-described embodiment, and various modifications can be made within a range not departing from the scope of the present invention. When the head-related transfer function selection device according to the embodiment is configured, the selection between hardware and software is arbitrary.

What is claimed is:

1. A sound reproduction device comprising:

a measuring unit configured to obtain a head-related impulse response of a user based on a sound signal which is collected by a microphone worn on an ear of the user in a state where a predetermined sound as a measurement signal is outputted from a speaker;

a feature amount extraction unit configured to extract a feature amount of a frequency characteristic corresponding to the head-related impulse response, the feature amount being a frequency of a local peak in a frequency range of 10 kHz to 20 kHz of the head-related impulse response;

a characteristic selection unit configured to select a head-related transfer function from a database, where head-related transfer functions of many people are respectively made in association with feature amounts of head-related transfer functions, based on the feature amount extracted by the feature amount extraction unit; and a reproduction unit configured to perform a convolution operation with sound data and the head-related transfer function selected by the characteristic selection unit, and to reproduce the sound data.

2. The sound reproduction device according to claim 1, wherein the measuring unit obtains a plurality of head-related impulse responses of the user, the feature amount extraction unit extracts each frequency of a local peak in the frequency range of 10 kHz to 20 kHz of each of the head-related impulse response, as a plurality of feature amounts of frequency characteristics corresponding to the plurality of head-related impulse responses, and the characteristic selection unit selects a head-related transfer function from the database, based on the plurality of feature amounts extracted by the feature amount extraction unit.

3. The sound reproduction device according to claim 2, wherein a horizontal angle θ is 0° and an elevation angle γ is 0° in a state where the speaker is positioned in front of a face of the user, the measuring unit obtains the plurality of head-related impulse responses when the speaker is moved to a position where the horizontal angle θ is 0° or a predetermined positive or negative value and then is moved in an arc shape in a vertical direction to positions where the elevation angles γ are a plurality of values, respectively, and the feature amount extraction unit extracts feature amounts based on frequency characteristics corresponding to the plurality of head-related impulse responses.

4. The sound reproduction device according to claim 3, wherein the measuring unit further obtains a plurality of head-related impulse responses when the speaker is moved to positions where the elevation angles γ are 0° and the horizontal angles θ are predetermined positive and negative values, respectively.

5. A sound reproduction method comprising:

generating a predetermined sound as a measurement signal from a speaker;

obtaining a head-related impulse response of a user based on a sound signal of the predetermined sound which is collected by a microphone worn on an ear of the user;

extracting a feature amount of a frequency characteristic corresponding to the head-related impulse response, the feature amount being a frequency of a local peak in a frequency range of 10 kHz to 20 kHz of the head-related impulse response;

selecting a head-related transfer function from a database, where head-related transfer functions of many people are respectively made in association with feature amounts of head-related transfer functions, based on the extracted feature amount; and performing a convolution operation with sound data and the selected head-related transfer function to reproduce the sound data.

6. A sound reproduction program stored in a non-transitory storage medium, the program allowing a computer to execute:

a step of obtaining a head-related impulse response of a user based on a sound signal which is collected by a microphone worn on an ear of the user in a state where a predetermined sound as a measurement signal is outputted from a speaker;

a step of extracting a feature amount of a frequency characteristic corresponding to the head-related impulse response, the feature amount being a frequency of a local peak in a frequency range of 10 kHz to 20 kHz of the head-related impulse response;

a step of selecting a head-related transfer function from a database, where head-related transfer functions of many people are respectively made in association with feature amounts of head-related transfer functions, based on the extracted feature amount; and a step of performing a convolution operation with sound data and the selected head-related transfer function to reproduce the sound data.

* * * * *